US005934270A

United States Patent [19]

Kim

[11] Patent Number: 5,934,270

[45] Date of Patent: Aug. 10, 1999

[54] FIREPLACE HEAT EXCHANGE DEVICE

[76] Inventor: Sinil Kim, 548 Ford Ave., Solana Beach, Calif. 92075

[21] Appl. No.: 08/791,252

[22] Filed: Jan. 30, 1997

[51] Int. Cl.[6] ..... F24B 1/188

[52] U.S. Cl. ..... 126/524; 126/72

[58] Field of Search ..... 126/109, 513, 126/72, 521, 522, 523, 524, 525, 526, 500; 165/142

[56] References Cited

U.S. PATENT DOCUMENTS

| | | | |
|---|---|---|---|
| 92,526 | 7/1869 | Hamilton | 126/109 |
| 94,709 | 9/1869 | Campbell et al. | 126/109 |
| 112,120 | 2/1871 | Burrell | 126/526 |
| 114,280 | 5/1871 | Farris | 126/526 |
| 386,391 | 7/1888 | Ellison | 126/526 |
| 861,455 | 7/1907 | Gates | 126/513 |
| 1,191,848 | 7/1916 | Stout | 126/109 |
| 1,835,323 | 12/1931 | Olson et al. | 126/109 |
| 2,665,556 | 2/1954 | Otten | 165/142 |
| 2,828,078 | 3/1958 | Snodgrass | 126/526 |
| 2,856,905 | 10/1958 | Bowen | 165/142 |
| 3,001,521 | 9/1961 | Reilly | 126/522 |
| 3,397,745 | 8/1968 | Owens | 165/142 |
| 3,574,357 | 4/1971 | Tirgoviste et al. | 165/142 |
| 3,674,248 | 7/1972 | Shellenberger | 165/142 |
| 3,880,141 | 4/1975 | Abshear . | |
| 3,901,212 | 8/1975 | Stites . | |
| 3,905,351 | 9/1975 | Hatfield et al. . | |
| 3,911,894 | 10/1975 | Richard, Jr. et al. | 126/526 |
| 3,955,553 | 5/1976 | Soeffker . | |
| 4,042,160 | 8/1977 | Ickes | 126/526 |
| 4,074,681 | 2/1978 | Whiteley . | |
| 4,091,794 | 5/1978 | Stites . | |
| 4,180,053 | 12/1979 | Patel | 126/526 |
| 4,197,829 | 4/1980 | Pierce . | |
| 4,269,266 | 5/1981 | Coates, Jr. et al. | 165/142 |
| 4,330,031 | 5/1982 | Shefsiek | 165/142 |
| 4,332,236 | 6/1982 | Stora . | |
| 4,895,137 | 1/1990 | Jones et al. | 126/526 |
| 5,038,754 | 8/1991 | Scala . | |
| 5,139,012 | 8/1992 | Furman et al. . | |
| 5,718,218 | 2/1998 | Pagani et al. | 126/526 |

FOREIGN PATENT DOCUMENTS

| | | | |
|---|---|---|---|
| 2540226 | of 1984 | France | 126/514 |
| 2227556 | of 1990 | United Kingdom | 165/142 |

*Primary Examiner*—James C. Yeung
*Assistant Examiner*—David Lee

[57] ABSTRACT

A heat exchange device is disclosed herein to be used in conjunction with a standard fireplace. The heat exchange device is made from a continuous tube fabricated into loops that surround the burning fuel. The ambient room air, introduced through an opening for air entry into the tube, is blown through the internal lumen of the tube fabricated into loops, the external surfaces of which are in direct contact with burning fuel and flame. The air passing through the internal lumen of the tube fabricated into loops is heated to a high temperature by the burning fuel and flame.

15 Claims, 5 Drawing Sheets

FIREPLACE HEAT EXCHANGE DEVICE

FIELD OF THE INVENTION

This invention relates generally to heat exchangers and in particular to a forced-air heat exchangers for use with a fireplace wherein the heat exchanger forces room air through loops of tube located within the fireplace and recirculates heated air back into the room.

DESCRIPTION OF PRIOR ART

One purpose for a modern fireplace is to give aesthetic beauty to the but many people still use it for the original intended purpose of heating the room. However, fireplaces are notoriously inefficient for this purpose. Much of the heat generated by burning fuel goes up the chimney rather than being transferred forward into the room. Hence, various heat exchangers have been developed to increase heat transfer into the room.

One heat exchanger is disclosed in U.S. Pat. No. 5,139,012 issued to Furman et al on Aug. 18, 1992 that includes a cylindrical heat reservoir through which air is blown to be heated. The heat exchange surface area afforded by the heat reservoir is not very large and the device is not efficient as a heat exchanger.

Another heat exchanger is disclosed in U.S. Pat. No. 4,074,681, issued to Whiteley on Feb. 21, 1978, that includes a U-shaped conduit placed flat on the floor of the fireplace and a fan that forces air from a room through the conduit. Again, the heat-exchange surface area afforded by the U-shaped conduit is not very large and not very efficient in extracting the heat from the fireplace.

A series of heat exchangers disclosed in U.S. Pat. No. 4,332,236 issued to Stora et al on Jun. 1, 1982, U.S. Pat. No. 4,197,829 issued to Pierce on Apr. 15, 1980, U.S. Pat. No. 3,905,351 issued to Hatfield et al on Sep. 16, 1975, U.S. Pat. No. 3,901,212 issued to Stites on Aug. 16, 1975, U.S. Pat. No. 4,091,794 issued to Stites on May 30, 1978, and U.S. Pat. No. 3,955,553 issued to Soeffker on May 11, 1976, all use a plurality of parallel U-shaped or C-shaped tubes wherein a manifold distributes the room air into the tubes. The plurality of parallel U-shaped or C-shaped tubes and the air-distributing manifolds are complicated structures that are costly to manufacture.

U.S. Pat. No. 3,880,141, issued to Abshear on Apr. 19, 1975 and U.S. Pat. No. 5,038,754 issued to Scala on Aug. 13, 1991 discloses a heating system for fireplace that positions a relatively flat heat exchanger inside the fireplace. These are also complicated structures that are costly to manufacture and the surface area available for heat exchange is limited with low efficiency of heat transfer.

Thus, there still exists a need for fireplace heat exchangers that are simple and inexpensive to manufacture and have large surface area for efficient extraction of the heat from the fireplace.

SUMMARY OF THE INVENTION

Accordingly, the above problems and difficulties are obviated by the use of a heat exchange device made from a continuous tube fabricated into loops that surround the burning fuel. The ambient room air, introduced through an opening for air entry into the tube, is blown through the internal lumen of the tube fabricated into loops, the external surfaces of which are in direct contact with burning fuel and flame. The air passing through the internal lumen of the tube fabricated into loops is heated to a high temperature by the burning fuel and flame. As the air gains heat from the tube wall, the tube wall loses heat, preventing the tube from getting heated to a very high temperature than can cause breakdown of the tube material. The heated air is finally blown back into the room through the opening for air exit out of the heat exchange device.

A preferred embodiment of the present invention employs a continuous tube with an opening for air entry through which ambient room air is admitted. This opening for air entry leads into one or more loops of continuous tube. At the end of the last loop of the continuous tube, another opening is provided for air exit out of the heat exchanger. The loops of continuous tube determine the boundaries of a space or fire-burning cavity where the fuel is preferably burned. Since a continuous tube is used for making the heat exchanger of present invention, it can be fabricated inexpensively without involving extensive welding. Preferably, a motor-driven fan is affixed to the opening for air entry to forcibly blow the air through the heat exchanger.

Another embodiment of the present invention employs heat-insulating material to minimize heat loss. Not all part of the heat exchanger is close to the flame or burning fuel. Heat loss from surfaces of the heat exchanger remote from the flame decreases the thermal efficiency. The thermal efficiency of the heat exchanger is improved by insulating portions of the heat exchanger that are remote from the flame or burning fuel. This can be accomplished by many different methods, but the preferred method is to coat the surface of the tube, either on the external surface (extralumenal) or internal surface (lumenal) surface of the metallic tube with heat-insulating materials such as fiberglass, polymer, or mirror-finished surface.

Another embodiment of the present invention employs heat-conducting or heat-absorbing material to maximize heat absorption from the flame or burning fuel. The heat transfer efficiency is improved by constructing portions of the heat exchanger out of heat-conducting or heat-absorbing material, such as iron, aluminum, copper, chromium, nickel, cobalt, silver, gold, platinum, and combinations thereof. Using these heat conductors to construct the portions of heat exchangers closest to the flame or burning fuel is a preferred embodiment of this invention. The surfaces of heat exchanger can be coated with heat absorbing material such as black pigments to further increase efficiency.

Another embodiment of the present invention employs a double-lumen tube. In this embodiment, ambient room air is introduced through an opening for air entry into one (inlet lumen) of the two lumens of the tube and the air is blown along the inlet lumen. At the distal end of the inlet lumen, one or more communicating apertures between the two lumens allow the air to pass into the second lumen (outlet lumen). The air now moves in the opposite direction along the outlet lumen to be released into the room at the end of the lumen through the opening for air exit.

Another embodiment of the present invention employs a continuous-tube heat exchanger provided with intra-lumenal baffle to effect mixing of the air flowing within the tube. This results in increased efficiency of heat transfer by disrupting laminar flow of air within the heat exchanger lumen.

It is among the primary objectives of the present invention to provide an improved and novel heat exchanger device made substantially from easily fabricated continuous tube for use in combination with a conventional fireplace so that ambient-temperature room air may be drawn in through the device and heated for discharge back into the room.

Another objective of the present invention is to provide a novel heat exchanger for use in combination with a conventional fireplace whereby the surface of heat exchanger that is close to the flame and hot coal is coated with or constructed from heat-absorbing or heat-conducting material.

Further objective of the present invention is to provide a novel heat exchanger for use in combination with a conventional fireplace whereby the surface of heat exchanger that is remote to the flame and hot coal is coated with or constructed from heat-reflecting or heat-insulating material.

Still further objective of the present invention is to provide a novel heat exchanger having a blower means for conducting an air flow from the room through the heat exchanger for discharge back into the room.

Still further objective of the present invention is to provide a novel heat exchanger that is simple and economical to fabricate so that the use of present invention is more efficient, cost effective, and can be used more widely compared to prior art.

BRIEF DESCRIPTION OF THE DRAWINGS

The features of the present invention which are believed to be novel are set forth in particularity in the appended claims. The present invention, both as to its organization and manner of operation, together with further object and advantages thereof, may best be understood with reference to the following descriptions, taken in connection with the accompanying drawings in which:

DESCRIPTION OF THE PREFERRED EMBODIMENTS

Loops or coil as defined in this disclosure is a connected series of spirals, rings, triangles, quadrangles, or other polygons into which a tube is wound. As defined in this invention, "C" or "U" shape is not a loop.

The term heat insulator as defined in this disclosure means materials with low conductivity and/or absorptivity of thermal energy. The term heat conductor as defined in this disclosure means materials with high conductivity and/or absorptivity of thermal energy.

The term lumen as defined in this disclosure means the canal or duct of a tubular structure. The term double-lumen tube as defined in this disclosure means a tube with two canals or ducts within a single tube. The inlet lumen is defined as the lumen that accepts air admitted through the opening for air entry. The outlet lumen is defined as the lumen that carries air in the opposite direction to the opening for air exit. Extra-lumenal means outside the canal or duct of a tubular structure and intra-lumenal means inside the canal or duct of a tubular structure.

The term continuous tube, as defined in this disclosure, means a single continuous tube or more than one tubes joined, welded, or connected into a single unit such that fluid can flow from one end of the tube to the other end.

The term baffle, as defined in this disclosure, means a partial obstruction for deflecting flow of air.

Figure 1:
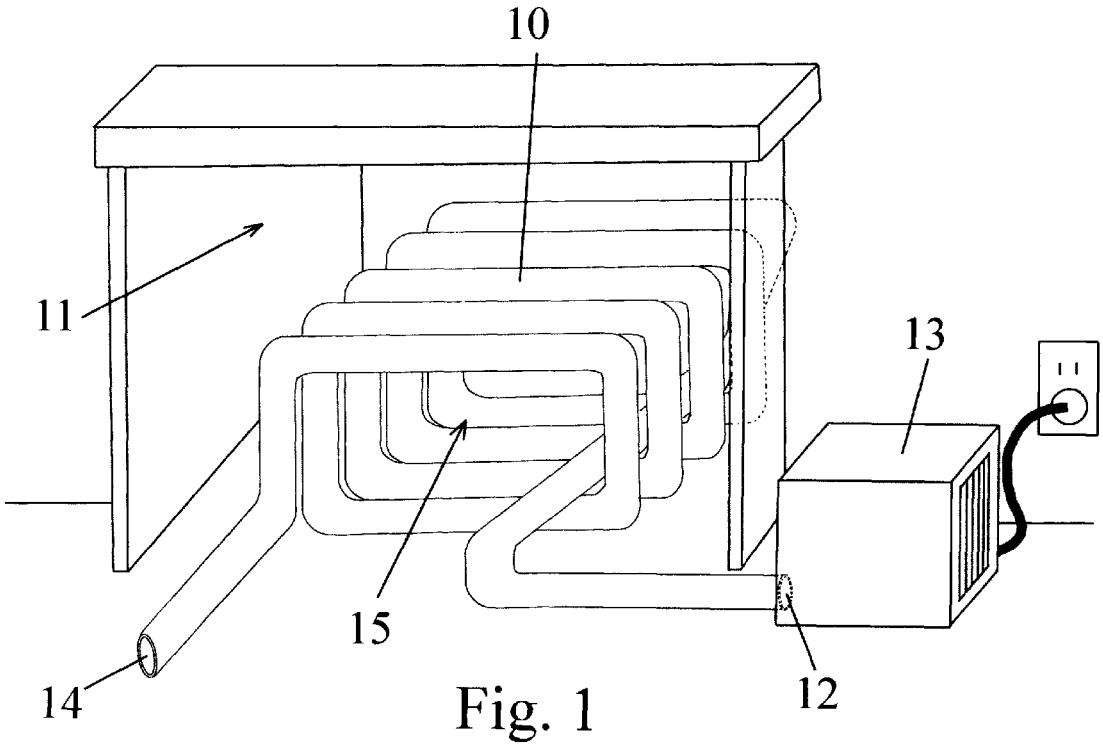
FIG. 1 is a front perspective view of a conventional fireplace incorporating the novel heat exchanging device in the fireplace in accordance with the present invention.

Referring to FIG. 1, the novel heat exchange device of the present invention is indicated by the numeral 10, which is used in combination with a conventional fireplace, indicated by numeral 11. The heat exchange device of the present invention 10 takes the form of a continuous tube fabricated in a general shape of loops of continuous tube. In addition to the loops of continuous tube, the heat exchange device has an opening for air entry 12, in this case, connected to a blower means 13 and another opening 14 for air exit out of the heat exchange device. The loops of continuous tube determine the boundaries of a fire-burning cavity 15 where fuel is preferably burned.

Figure 2:
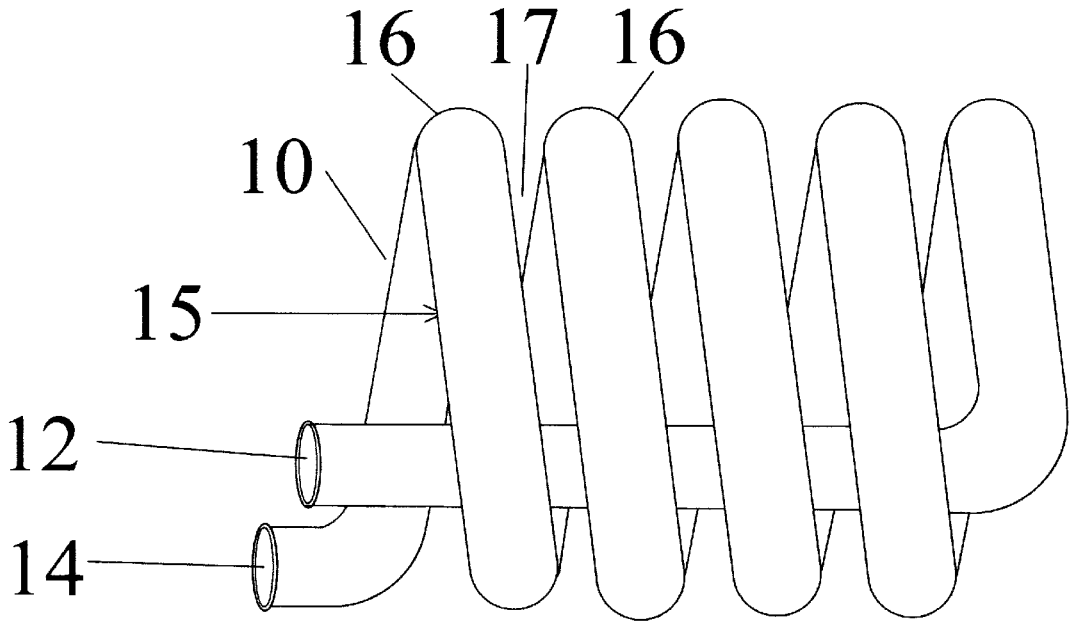
FIG. 2 is a side view of a preferred embodiment of the invention

Loops 16 of continuous tube is easier to appreciate when seen in a side view. FIG. 2 shows the side view of the present invention. The novel heat exchange device of the present invention 10 has a continuous tube fabricated in loops 16 with an opening 12 for air entry into the heat exchange device. The opening for air exit out of the heat exchange device is hidden behind the opening for air entry in this side view. It is preferred to allow a gap 17 between the loops 16 to facilitate air flow into the burning fuel, to facilitate escape of gaseous and solid product of combustion to escape from the fire-burning cavity 15.

Figure 3:
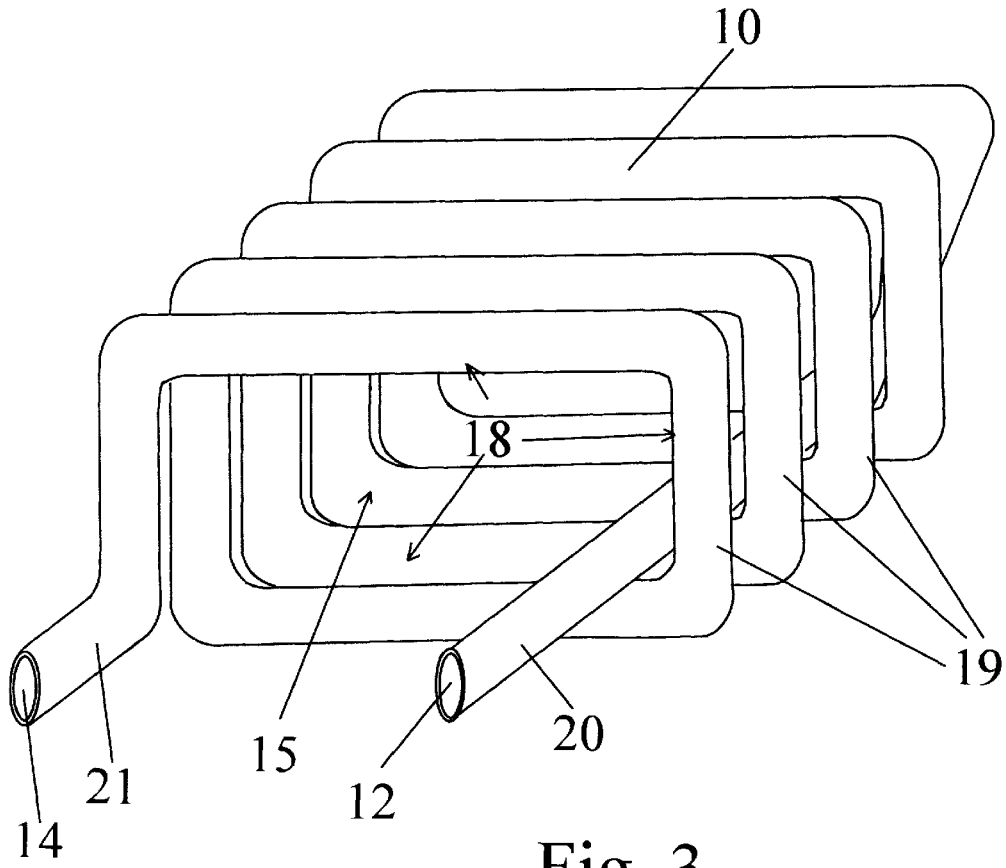
FIG. 3 is a perspective view of a preferred embodiment of the invention.

FIG. 3 shows another perspective view of the heat exchange device of the present invention 10, which takes the form of a continuous tube fabricated in a general shape of loops of continuous tube. In addition to the loops of continuous tube, the heat exchange device has an opening for air entry 12 and another opening 14 for air exit out of the heat exchange device. The loops of continuous tube determine the boundaries of a fire-burning cavity 15 where fuel is preferably burned.

For increased efficiency of heat transfer, the surface 18 of the heat exchange device adjacent to the fire-burning cavity 15 is preferably composed of or coated with heat-conducting or heat-absorbing material such as black pigment, iron, aluminum, copper, chromium, nickel, cobalt, silver, gold, platinum, or combinations thereof.

To decrease heat loss from the parts of the heat exchanger remote from heat source, the surfaces 19, 20, or 21 of the heat exchange device remote from the fire-burning cavity 15 is composed of or coated with heat-insulating or heat-reflecting material such as mirror-finished surface, fiberglass, or polymers.

Figure 4:
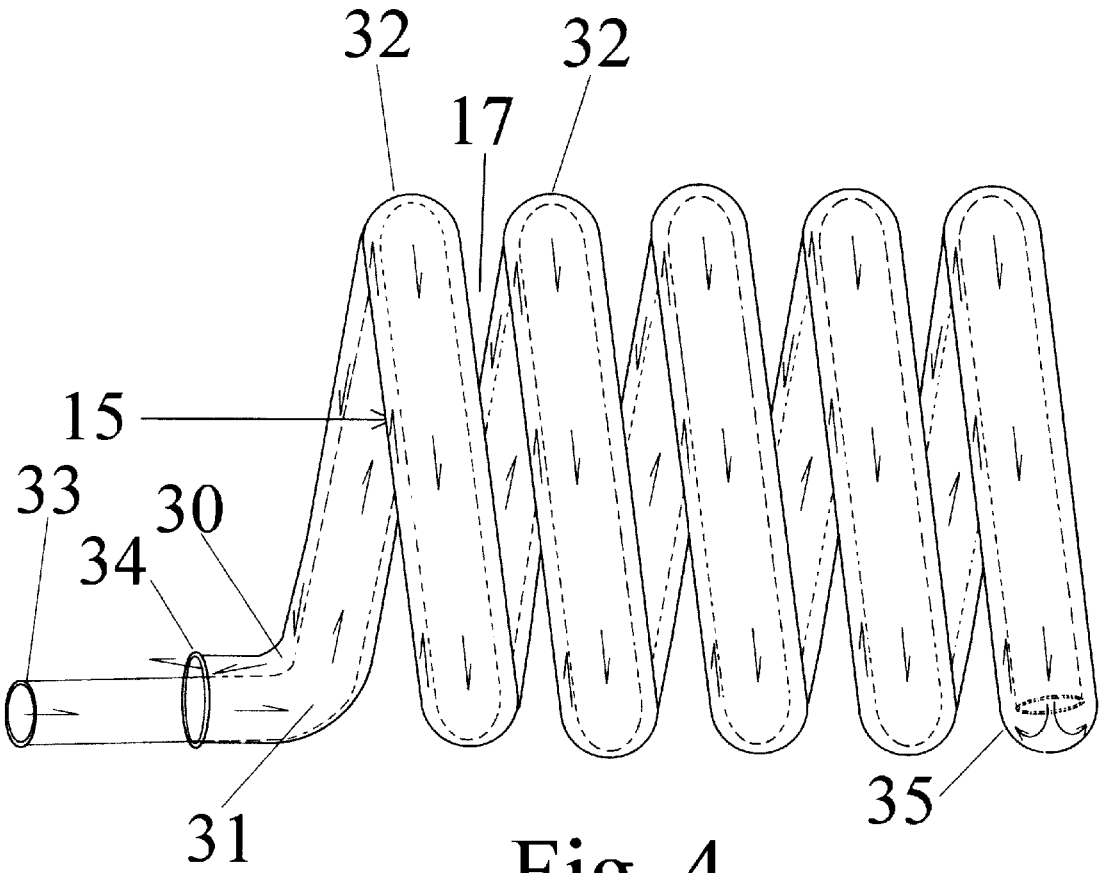
FIG. 4 is a side view of a heat exchange device comprising a double-lumen tube.

FIG. 4 shows another embodiment of the present invention. FIG. 4 shows the side view of the double-lumen heat exchange device which has a continuous tube with two lumens 30 and 31 fabricated in loops 32. In this particular embodiment, one of the two lumens, 31, is located within the other lumen 30, and is depicted by dashed line. The double-lumen heat exchange device has an opening 33 for air entry into the heat exchange device. There is a communicating aperture 35 which allows air from one lumen to flow into the other lumen. In operation, the air is forced into the heat exchange device through the opening for air entry 33 and travels along the inlet lumen 31. At the end of the inlet lumen, the air then passes through the communicating aperture 33 into the outlet lumen 30. The air now travels in the opposite direction through the outlet lumen 30, to finally exit through the air outlet opening 34. It is preferred to allow an air gap 17 between the loops 32 to facilitate air flow into the burning fuel, to facilitate escape of gaseous and solid product of combustion from the fire-burning cavity 15.

Figure 5:
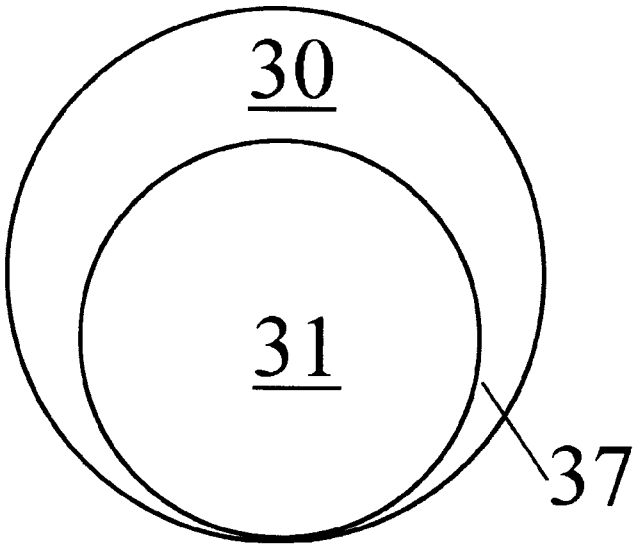
FIG. 5 is cross section view of a double-lumen tube.
Figure 6:
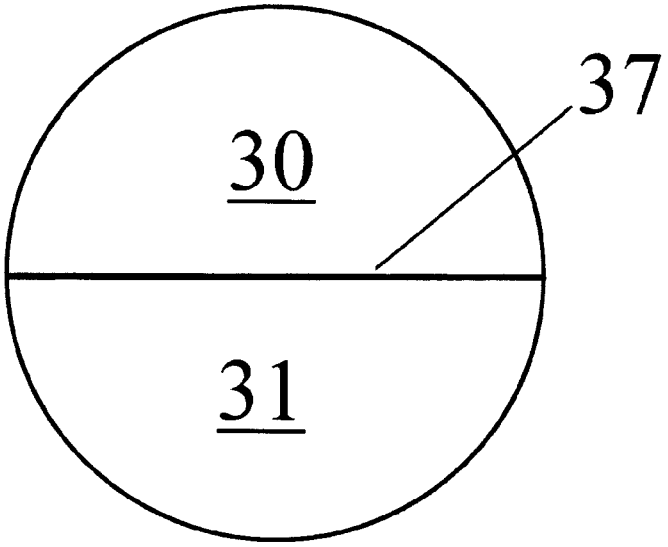
FIG. 6 is cross section view of another embodiment of double-lumen tube.

FIG. 5 shows the cross section view of a double-lumen tube, with lumens 30 and 31 comprising the two lumens, one located within in the other. FIG. 6 shows the cross section view of another embodiment of a double-lumen tube, with lumens 30 and 31 comprising the two lumens, located side by side. Because the inlet lumen 31 carries ambient room temperature air whereas the outlet lumen 30 carries hot air, the wall 37 separating the two lumens 30 and 31 is preferably comprised of heat-insulating or heat-reflecting material such as fiberglass, polymer, or mirror-finished surface.

Another embodiment of the present invention is a continuous-tube heat exchange device with intralumenal baffle to cause turbulent flow within the lumen of the tube to mix the air. Such mixing of the intralumenal air increases efficiency of the heat exchanges devices with minimal increase in resistance to air flow.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A forced-air heat-exchanger apparatus for a fireplace promoting heating of room air via placement substantially within a fireplace; said apparatus comprising:

a) a continuous tube having at least two ends, an extralumenal surface covering the entire external surface of the tube, and an intralumenal surface covering the entire internal surface of the tube, the continuous tube substantially coiled in a form of approximate spirals or approximate polygons of several turns, b) an internal lumen or bore of the tube extending continuously from one of the two ends of said continuous tube to the other end of the continuous tube to accommodate movement and heating of said room air, c) an air-entry opening at one of the two end of said continuous tube for entry of the room air into said internal lumen or bore of the tube and the air-entry opening positioned substantially outside the fireplace, d) an air-exit opening at the other end of said continuous tube for discharge of heated room air out of said internal lumen into the room and the air-exit opening positioned substantially outside the fireplace, and e) an air-blower means attached to said air-entry opening or air-exit opening for forced movement of the room air into the air-entry opening, through the continuous internal lumen, and out the air-exit opening into the room.

2. A forced-air heat-exchanger apparatus for a fireplace according to claim 1, wherein the coiled continuous tube forms a grating means upon which normal fireplace burning materials can be placed for heating of said continuous tube.

3. A forced-air heat-exchanger apparatus for a fireplace according to claim 1, wherein the coiled continuous tube forms a central cavity in which normal fireplace burning materials can be placed for heating of a substantial portion of said continuous tube, with a remaining portion of the tube substantially unheated.

4. A forced-air heat-exchanger apparatus for a fireplace according to claim 3, wherein the unheated portion of said continuous tube further includes a heat insulator means, thereby maintaining the heated temperature of room air moving through the internal lumen.

5. A forced-air heat-exchanger apparatus for a fireplace according to claim 4, wherein said heat insulator means is in a form of coating attached to the extralumenal surface and/or intralumenal surface of said tube.

6. A forced-air heat-exchanger apparatus for a fireplace according to claim 4, wherein the heat insulator means is selected from the group comprising: fiberglass and polymer.

7. A forced-air heat-exchanger apparatus for a fireplace according to claim 3, wherein the unheated portion of said continuous tube further includes a heat reflector means for reflecting outward migrating heat-radiation, thereby maintaining the heated temperature of the air within the internal lumen.

8. A forced-air heat-exchanger apparatus for a fireplace according to claim 7, wherein the heat reflector means is mirror finished surface.

9. A forced-air heat-exchanger apparatus for a fireplace according to claim 3, wherein the heated portion of said continuous tube further includes a heat conductor means, thereby facilitating transference of heat to the air moving through the internal lumen.

10. A forced-air heat-exchanger apparatus for a fireplace according to claim 9, wherein said heat conductor means is provided in a form of coating attached to the extralumenal surface and/or intralumenal surface of said tube.

11. A forced-air heat-exchanger apparatus for a fireplace according to claim 9, wherein the heat conductor means is selected from the group comprising: black pigment, iron, aluminum, copper, chromium, nickel, cobalt, silver, gold, platinum, and combinations thereof.

12. A forced-air heat-exchanger apparatus for a fireplace according to claim 3, wherein the heated portion of said continuous tube further includes a baffle means within the internal lumen for causing turbulent air flow within the lumen to increase efficiency of heat exchange.

13. A forced-air heat-exchanger apparatus for a fireplace promoting heating of room air via placement substantially within a fireplace; said apparatus comprising:

a) a continuous tube having an open end and a closed end, the continuous tube substantially coiled in a form of approximate spirals or approximate polygons of several turns, b) two internal lumens separated by a wall within the tube extending substantially from the open end of the tube to the closed end of the continuous tube, c) one or more communicating aperture means between the two internal lumens, said aperture means placed adjacent to the closed end of the tube for flow of air from one of the two internal lumens to the other internal lumen, d) an air-entry opening at the open end of said continuous tube for entry of the room air into one of the two internal lumens of the tube and the air-entry opening positioned substantially outside the fireplace, e) an air-exit opening at the open end of said continuous tube for discharge of heated room air out of the second internal lumen into the room and the air-exit opening positioned substantially outside the fireplace, and f) an air-blower means attached to said air-entry opening or air-exit opening for facilitating movement of the room air into the air-entry opening, through one of the two internal lumen, through the communicating aperture means, through the second internal lumen, and out the air-exit opening into the room.

14. A forced-air heat-exchanger apparatus for a fireplace according to claim 13, wherein the wall separating the two internal lumens further includes a heat insulator means of low thermal conductance, thereby reducing heat transfer from one lumen to the other.

15. A forced-air heat-exchanger apparatus for a fireplace according to claim 14, wherein the heat insulator means is selected from the group comprising: fiberglass and polymer.

* * * * *